US005496412A

United States Patent [19]

Ahmad

[11] Patent Number: 5,496,412

[45] Date of Patent: Mar. 5, 1996

[54] APPARATUS AND METHOD FOR CLEANING ROTARY APPLICATOR DEVICES

[76] Inventor: Shamoon Ahmad, 358-C Crowells Rd., Highland Park, N.J. 08904

[21] Appl. No.: 207,147

[22] Filed: Mar. 8, 1994

[51] Int. Cl.[6] ..... B05C 17/02; B08B 3/04

[52] U.S. Cl. ..... 134/6; 15/1; 15/3; 15/104.92

[58] Field of Search ..... 15/38, 104.92, 15/97.1, 1, 3; 134/138, 139, 149, 6

[56] References Cited

U.S. PATENT DOCUMENTS

| | | | |
|---|---|---|---|
| 2,773,274 | 12/1956 | Beech | 15/3 |
| 2,819,483 | 1/1958 | Macaulay | 15/104.92 |
| 2,895,154 | 7/1959 | Belcher | 15/104.92 |
| 2,929,387 | 3/1960 | Boyden | 134/149 |
| 3,431,574 | 3/1969 | Mathieu | 15/104.92 |
| 4,130,443 | 12/1978 | Dulin | 134/149 |
| 4,320,550 | 3/1982 | McGrew | 15/104.92 |

FOREIGN PATENT DOCUMENTS

| | | | |
|---|---|---|---|
| 8301131 | 10/1984 | Netherlands | 15/104.92 |

*Primary Examiner*—Edward L. Roberts, Jr.

[57] ABSTRACT

A rotary applicator cleaning device in which a roller is placed within a housing and rotated within that housing as it is subjected to a cleaning solution and a resilient scrubbing.

6 Claims, 2 Drawing Sheets

APPARATUS AND METHOD FOR CLEANING ROTARY APPLICATOR DEVICES

FIELD OF THE INVENTION

The invention described in this specification is primarily intended to be utilized in the area of cleaning rotary applicators, such as common house painting rollers, for applying coatings, such as house paint and stain. While it is not necessarily limited to any particular use, it is especially advantageous for reusable fluffy paint applicator roller that must be cleaned after each use.

DESCRIPTION OF THE PRIOR ART

In the past, when paint roller had to be cleaned after use one usually had to do it by hand. This included the messy steps of squeezing the paint out of the roller, washing the roller and then rinsing the roller to get it completely free of paint. If the process wasn't performed accurately or completely, paint remained on the roller and upon drying the roller was stiff and unacceptable for reuse.

While there are some cleaning apparatus on the market that aide in the above cleaning process, they do not perform all of the above steps without having to remove the roller from within the cleaning apparatus nor do they insure a complete cleaning and rinsing of the paint roller.

In view of the above it is fair and accurate to say that in the prior art there is no satisfactory cleaning device for cleaning rotary paint applicators in a simple, efficient and neat manner.

SUMMARY OF THE INVENTION

It is an object of the present invention to overcome the cleaning problems of the prior art by providing an apparatus and method for cleaning rotary painting applicators in a simple, efficient and neat manner.

Another object is to have a cleaning device that can accommodate various size rollers.

A still further object is to have the cleaning device perform the cleaning in a gentle manner so that it does not damage the normally soft fuzzy surface of the paint applicator roller.

Another object is to have the roller rinsed completely, while still maintained within the cleaning device.

The above objects are accomplished by a new and useful apparatus for cleaning and rinsing paint rollers comprised of:

a housing rotating retaining mean for holding and rotating the rotary applicator within the housing;

means for introducing a cleaning solution into the housing and onto the rotating rotary applicator;

means for expelling the cleaning solution and debris from the housing resilient means for scrubbing the rotating rotary applicator within the housing; and means for retaining the resilient means in scrubbing contact with the rotating rotary applicator.

A brief summary of the above type is inherently incapable of delineating many facets and features of an invention which are significant and important to indicate the many advantages of the invention as are normally apparent to one skilled in the art after a detailed study of the invention. It is considered that such items will be apparent to one skilled in the art from a detailed consideration of the remainder of this specification, the appended claims and the accompanying drawings.

An advantage to the above is that it allows one to clean a roller painting applicator in a simple process that assures cleaning and rinsing of the roller applicator to an extend that the roller is suitable for reuse.

A further advantage is the simplicity of the container design and the mounting of the roller within the container that allows for both the cleaning and rinsing of the roller without removal of the roller from the container or its mounting within the container.

BRIEF DESCRIPTION OF THE DRAWINGS

Further advantages and uses of this invention will become more apparent when considered in view of the following detailed description and drawings, in which.

DETAILED DESCRIPTION OF THE INVENTION

Figure 2:
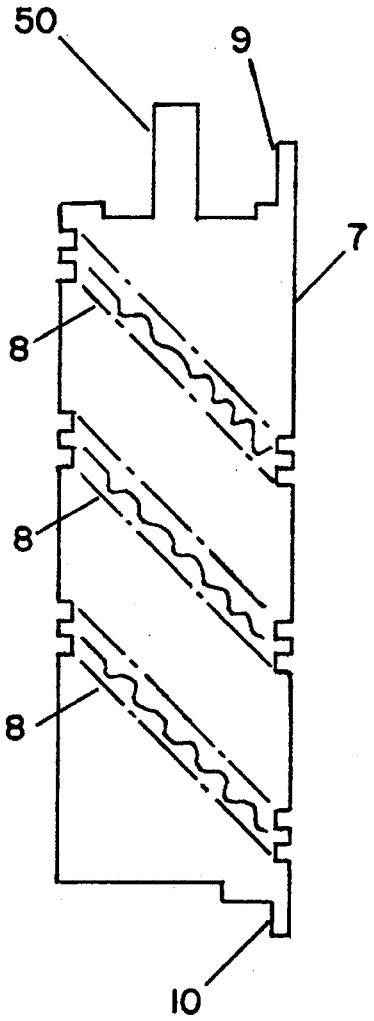
FIG. 2 Is a side view of the spring cleaning bracket in accordance with the present invention.

The cleaning apparatus and method of the invention will be described in relation to a standard paint roller applicator. The invention, however, is not limited to round paint rollers. It should therefore be understood that the present disclosure is to be considered only an exemplification of the principles of the invention and is not intended to limit the invention to only round paint rollers.

For ease of description, all apparatus will be described in their normal operational position, and terms such as upper, lower, horizontal, etc., will be used with reference to normal operation positions. All apparatus, however, may be manufactured, stored, transported and sold in an orientation other than the normal operational positions described herein. In addition any apparatus not specifically shown or described herein are selectable from those known in the art.

All references cited in this specification and their reference are incorporated by reference herein where appropriate, for appropriate teaching of additional or alternative details, features and/or technical background.

Throughout the following description, similar reference characters refer to similar elements or members in all of the figures of the drawings.

Figure 1:
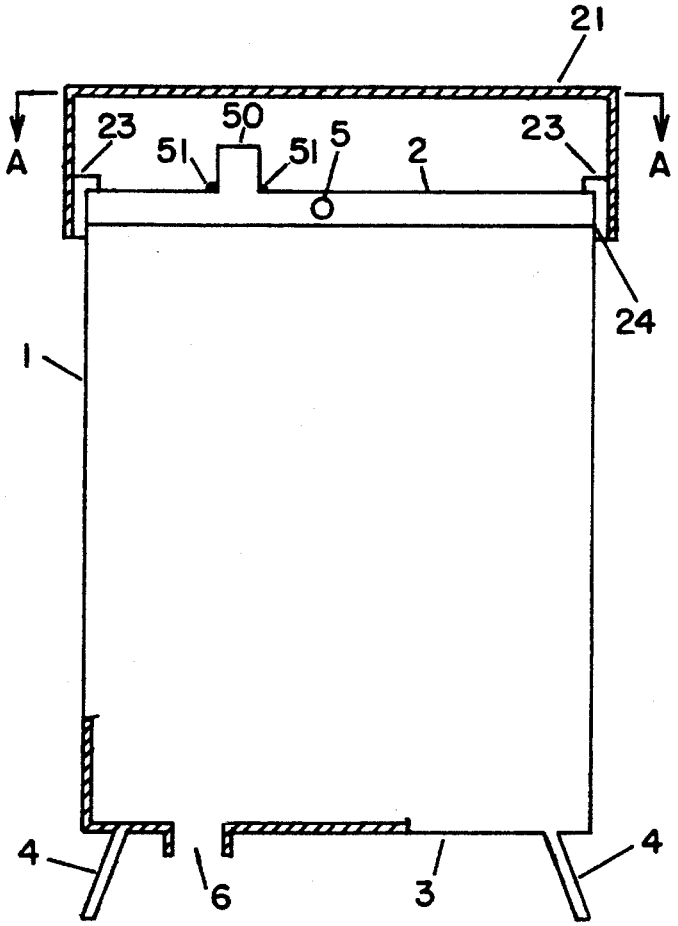
FIG. 1 Is a side view of the cleaning apparatus in accordance with the present invention.

Referring initially to FIG. 1, a housing 1, such as a hollow cylinder, having a top 2 and a bottom 3, is supported upon a pair of legs 4. The top 2 of housing 1 has an entrance port 5, see FIG. 4, for allowing a cleaning liquid, such as water, to enter the housing 1 through the top 2 and then later exit housing 1 through exit port 6 located in the bottom 2 of housing 1.

Figure 3:
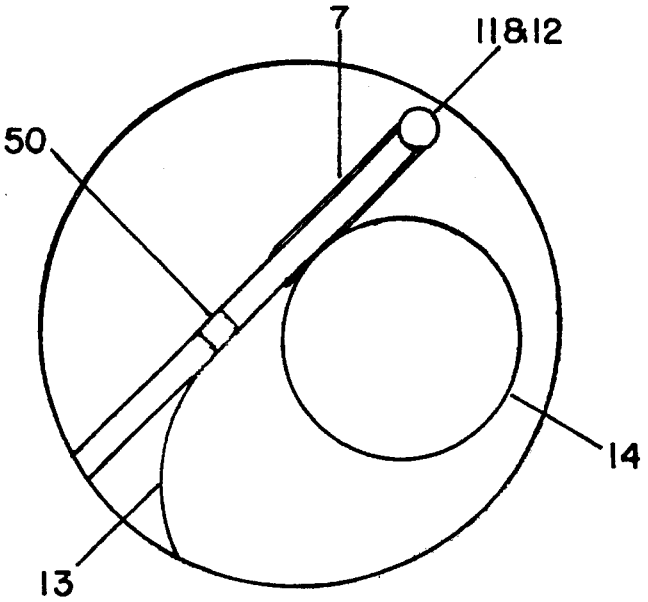
FIG. 3 Is a top view of the inside of the cleaning apparatus with the cover removed in accordance with the present invention.
Figure 5:
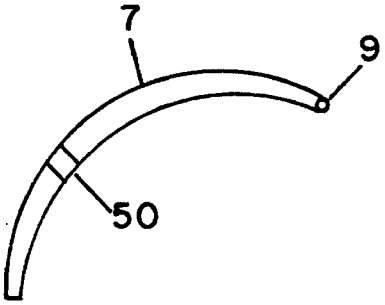
FIG. 5. Is a top view of the frame in its alternative curved form.

Removable contained within housing 1 is a spring retaining frame 7, having a relatively flat form, as shown in FIG. 2, or a curved structure as shown in FIG. 5. The curved surface of FIG. 5 being preferred when cleaning a paint applying apparatus having a curved surface that will conform to curved frame 7. Attached to retaining frame 7 are one or more resilient members 8, such as springs, and pivot arms 9 and 10. Pivot arms 9 and 10 are adapted to mate with pivot points 11 and 12, see FIG. 3 located in the top 2 and bottom 3 of housing 1. In this manner, when frame 7 is mounted in housing 1 with the top 2 of housing 1 in contact with the bottom 3, frame 7 is free to rotate about arms 9 and 10 within housing 1. In contact with frame 7 is resilient member 13, such as a band spring, that urges frame 7 away from paint roller 14 when roller 14 is placed within housing 1 for cleaning. Also attached to frame 7 is lever 50 for moving frame 7 toward and away from roller 14, as to be explained. When frame 7 is placed within housing 1, lever 50 extends through the surface of top 2 at slot 51. A seal is provided between top 2 and lever 50 to prevent the liquid contained in housing 1 from leaking at the point where lever 50 protrudes through slot 51 in top 2. Lever 50 is adapted to move within slot 51 of top 2 so that it may move frame 7 toward or away from the surface of roller 14. This movement of lever 50 may be through manual or motorized means.

Figure 4:
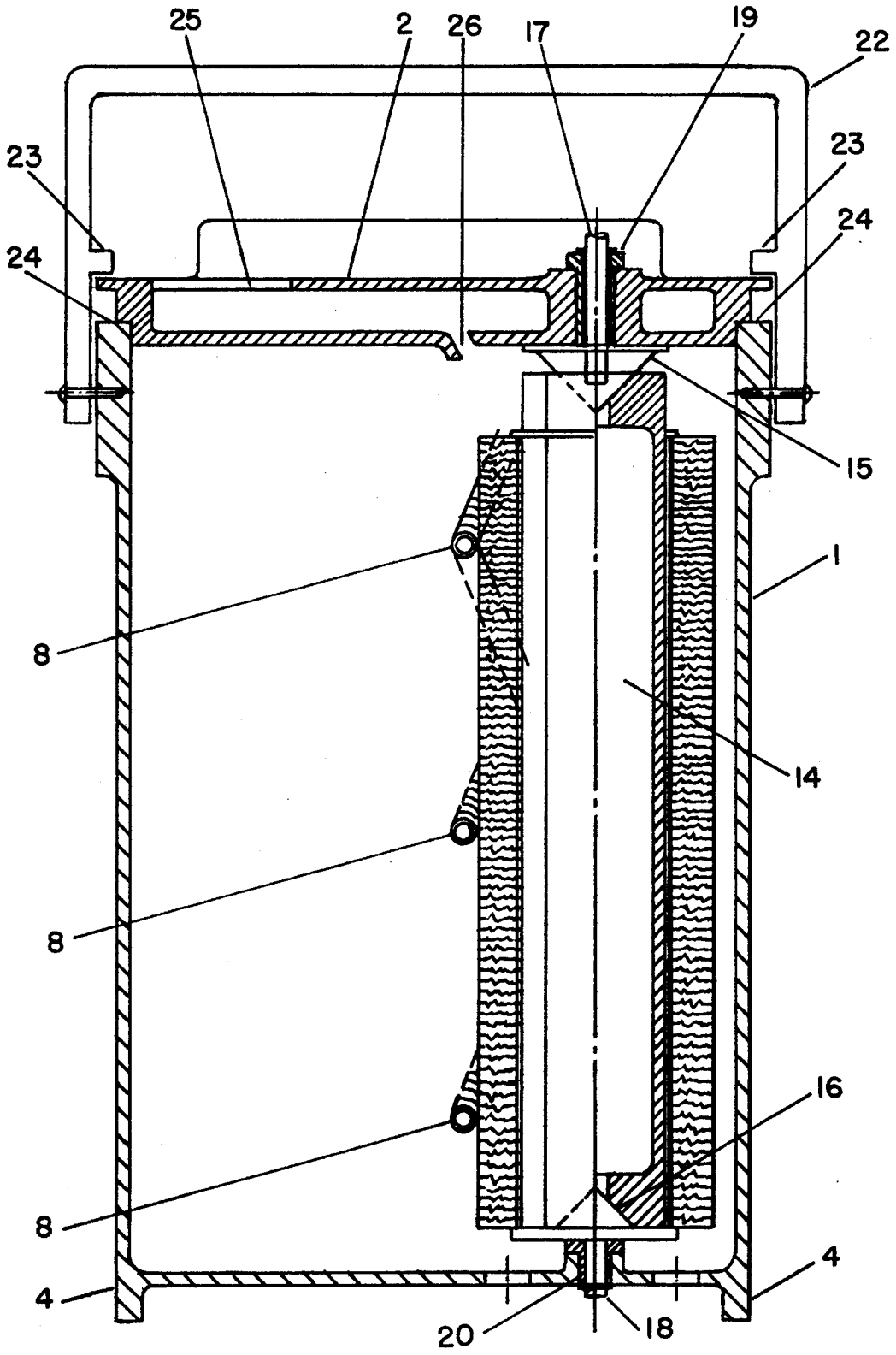
FIG. 4. Is a sectional view of the cleaning apparatus taken through points 4—4 of FIG. 1.

For mounting roller 14 within housing 1 for cleaning, mounting surfaces 15 and 16 are provided, see FIG. 4. The preferred shape of mounting surfaces 15 and 16, is cone shaped with said mounting surfaces 15 and 16 are mounted for rotation in top 2 and bottom 3 respectively. Either or both surface 15 and surface 16 maybe spring loaded so that when one end of roller 14 is place over surface 15 and the other end of roller 14 is place over surface 16 to hold roller 14 tightly as mounting surface 15 rotates on shaft 17 and mounting surface 16 rotates on shaft 18. Shaft 17 and shaft 18 respectively, rotate within shaft housing 19 and shaft housing 20 such that they may cause mounting surfaces 15 and 16 to rotate either by manual or motorized action. In the above manner when mounting surface 15 frictional mates with one internal opening of paint roller 14 and mounting surface 16 mates with the other internal opening of paint roller 14, roller 14 is caused to rotate within housing 1. Due to the cone shape of mounting surfaces 15 and 16 and the spring loading, any variance in internal opening diameter of roller 14 or length of roller 14 may be accommodated.

To maintain roller 14 positioned within housing 1 handle 22 is pivotal upon housing 1. When handle 22 is pivoted in one direction it locks top 2 securely upon bottom 3 by tabs 23 urging top 2 into contact with the top surface 24 of housing 1. When handle 22 is moved in the another direction it releases the top 2 from the top surface 24 of housing 1 so that the roller 14 may be either inserted or removed and the internal parts of housing 1 may be inspected, removed or cleaned.

Top 2 has a cleaning fluid channel 25 that directs the cleaning fluid that enters port 5 toward and though nozzle 26 so that the angle that cleaning fluid impact on roller 14 may be properly directed onto the surface of roller 14, as roller 14 rotates within housing 1, to aide in the cleaning process. Since springs 8 are positioned at an angle on frame 7, springs 8 are able to contact all surfaces of roller 14 as it rotates within housing 1 to assure full cleaning of roller 14. By moving lever 50 within slot 51 so that frame 7 moves spring 8 into and out of contact with the surface of roller 14, spring 8 or springs 8 exert a cleaning force on the surface of the roller 14 that cleans roller 14. The force must be such that it does not preclude the rotation of roller 14 within housing 1, but great enough that this force coupled with the cleaning fluid impacting upon the roller 14 cleans said roller 14. In addition because resilient member 13 urges frame 7 and thereby springs 8 away from roller 14, it aides in preventing the exerting of too great a force by spring 8 on roller 14 to avoid the rotation of roller 14 from being braked by the action of lever 50 on frame 7. In addition, since resilient member 13 urges frame 7 away from roller 14 and lever 50 enables one to move frame 7 toward roller 14 there is no need to have a fixed distance between roller 14 and spring 8, and therefore the cleaning apparatus can easily accommodate various external diameter rollers 14.

In operation, handle 22 is moved so that tabs 23 no longer interfere with the removal of top 2 from bottom 3. Roller 14, to be cleaned, is then inserted within housing 1, by placing one internal opening of roller 14 over mounting surface 16. Top 2 is then placed on bottom 3 such that mounting surface 15 mates with the other internal opening of roller 14. Handle 22 is then moved to place tabs 23 into interference contact with top 2, thereby causing top 2 to be securely fastened to bottom 3. Cleaning fluid in then introduced through port 5 into housing 1 and shaft 17 or shaft 18 is caused to rotate by either manual or by motorized activation. The rotation of shaft 17 or shaft 18 causes roller 14 to rotate against springs 8 which are urged into and out of contact with roller 14 by the movement of lever 50. The movement of spring 8 into roller 14 is counteracted by the force of resilient member 13 to avoid the rotation of roller 14 from being braked. The combined action of the cleaning fluid being directed toward roller 14 and the springs 8 making and breaking contact with roller 14 causes roller 14 to be cleansed and rinsed so that when roller 14 is removed from housing 1 and drys it is ready for re-use.

While the invention has been described in detail with particular reference to a preferred embodiment thereof, it should be understood that variations and modifications can be effected within the spirit and scope of the invention.

I claim as my invention:

1. A method for cleaning debris from a rotary applicator, the method including:

inserting the rotary applicator in a housing;

rotating the rotary applicator within the housing;

introducing a cleaning solution to the housing and directing that solution onto the rotary applicator as it rotates to clean debris from the rotary applicator;

providing a support structure having resilient means providing a resilient force for engaging a rotary applicator;

moving said support structure within the housing in order that a resilient force may be moved toward and away from the rotary applicator surface to provide for positioning the rotary applicator in a cleaning position;

continuing to move the support structure in order that the resilient force is moved into and out of contact with the rotary applicator as it rotates during the cleaning process; and removing the cleaning solution from the housing along with the debris removed from the rotary applicator.

2. An apparatus for removing debris from a rotary applicator, the apparatus comprising:

a housing;

rotating retaining means for holding and rotating the rotary applicator within the housing;

means for introducing a cleaning solution into the housing and onto the rotating rotary applicator;

means for expelling the cleaning solution and debris from the housing;

resilient means for scrubbing the rotating rotary applicator within the housing;

means for retaining the resilient means in scrubbing contact with the rotating rotary applicator; and a support structure for the resilient means, wherein the support structure includes means for mounting the support structure within the housing for movement toward and away from the rotary applicator surface to provide for positioning the rotary applicator in a cleaning position and resilient means mounted thereon into and out of contact with the rotary applicator.

3. The apparatus of claim 2 wherein the rotating retaining means includes two rotatable cones for matting with the ends of the rotary applicator.

4. The apparatus of claim 3 wherein at least one of the two rotatable cones is spring loaded to compensate for varying lengths of the rotary applicator.

5. The apparatus of claim 2 wherein the resilient means includes at least one spring mounted at an angle within a rectangular frame.

6. The apparatus of claim 2 further including a resilient member for urging the resilient means away from the rotating rotary applicator.

* * * * *